US006865362B2

(12) United States Patent
Otsuka et al.

(10) Patent No.: US 6,865,362 B2
(45) Date of Patent: Mar. 8, 2005

(54) HEATER HAVING METALLIC SUBSTRATE AND IMAGE HEATING APPARATUS USING HEATER

(75) Inventors: Yasumasa Otsuka, Shizuoka (JP); Kazuo Kishino, Kanagawa (JP); Masaaki Takahashi, Kanagawa (JP); Yusuke Nakazono, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/091,467

(22) Filed: Mar. 7, 2002

(65) Prior Publication Data

US 2002/0127035 A1 Sep. 12, 2002

(30) Foreign Application Priority Data

Mar. 12, 2001 (JP) ..... 2001-068653

(51) Int. Cl.[7] ..... G03G 15/20
(52) U.S. Cl. ..... 399/329
(58) Field of Search ..... 399/329, 328, 399/330, 335, 338; 219/216, 469

(56) References Cited

U.S. PATENT DOCUMENTS

| | | | | | |
|---|---|---|---|---|---|
| 3,591,276 | A | * | 7/1971 | Byrne | 399/338 X |
| 3,754,819 | A | * | 8/1973 | Braun | 219/216 X |
| 4,179,601 | A | * | 12/1979 | Tarumi et al. | 219/216 |
| 5,149,941 | A | | 9/1992 | Hirabayashi et al. | 219/216 |
| 5,303,016 | A | * | 4/1994 | Oda et al. | 399/329 |
| 5,355,204 | A | * | 10/1994 | Aoki | 399/329 |
| 5,697,037 | A | | 12/1997 | Yano et al. | 399/333 |
| 5,826,152 | A | * | 10/1998 | Suzuki et al. | 399/330 |
| 5,877,928 | A | | 3/1999 | Makino | 361/91 |
| 5,887,235 | A | * | 3/1999 | Wayman et al. | 399/329 |
| 6,094,559 | A | | 7/2000 | Otsuka et al. | 399/327 |
| 6,175,699 | B1 | | 1/2001 | Kato et al. | 399/69 |
| 6,366,745 | B1 | | 4/2002 | Adachi et al. | 399/68 |
| 6,377,777 | B1 | | 4/2002 | Kishino et al. | 399/329 |
| 6,583,389 | B2 | * | 6/2003 | Murooka et al. | 399/329 X |

FOREIGN PATENT DOCUMENTS

| | | | | |
|---|---|---|---|---|
| JP | 63-313182 | | 12/1988 | |
| JP | 9-244442 | | 9/1997 | |
| JP | 10-275671 | | 10/1998 | |
| JP | 11016667 | A * | 1/1999 | H05B/3/20 |
| JP | 2001-75394 | * | 3/2001 | |

* cited by examiner

*Primary Examiner*—Quana Grainger
(74) *Attorney, Agent, or Firm*—Fitzpatrick, Cella, Harper & Scinto

(57) ABSTRACT

An image heating apparatus has a non-rotatable heater with a metallic substrate together with a film that moves in contact with the heater and is accompanied by a backup roller which defines a nip with the heater via the film. The metallic substrate has a cylindrical shape and the heater has a first insulating layer on an outer peripheral surface of the metallic substrate, a heat generating resistor on the first insulating layer and a second insulating layer on the heat generating resistor.

7 Claims, 6 Drawing Sheets

HEATER HAVING METALLIC SUBSTRATE AND IMAGE HEATING APPARATUS USING HEATER

BACKGROUND OF THE INVENTION

1. Field of the Invention

The present invention relates to an image heating apparatus and a heater for heating suitably used as a heat-fixing apparatus to be mounted on a copying machine, a printer or the like using a recording technology such as an electrophotographic type or an electrostatic recording type recording technology, and more particularly to an apparatus using a metal substrate as a substrate of a heater.

2. Related Art

Conventionally, a heat roller type heating device has been extensively used in a device for heat-fixing processing as a permanently fixed image on a recording material surface an unfixed toner image corresponding to target image information formed in a direct manner or an indirect (transfer) manner on a surface of a recording material (an electrofacsimile sheet, an electrostatic recording sheet, a transfer material sheet, a printing sheet or the like) by using toner made of thermally meltable resin or the like by suitable image forming process means such as an electrophotographic recording technology, an electrostatic recording technology, a magnetic recording technology or the like, i.e., a heat-fixing apparatus in an image forming apparatus such as a copying machine, a printer, a facsimile or the like using, for example, an electrophotographic system.

The above-described heat roller type is basically composed of a roller made of metal and provided therein with a heater and a pressure roller having elasticity, which is brought into a press-contact with the roller. The recording material is caused to pass through a fixing nip portion defined by a pair of these rollers, whereby an unfixed toner image borne on the recording material is heated and pressurized to be fixed.

Also, the present applicant previously proposes a film heating type heating device in Japanese Patent Application Laid-open No. 63-313182 or the like.

According to this film heating system, a heater (heating body) and a heated member are respectively brought into contact on one side and the other side of a heat resistant film so that a thermal energy of the heater is given to the heated member via the heat resistant film. It is possible to use a film or a heater having a low heat capacity. Accordingly it is possible to shorten wait time (quick start, on-demand fixing) in comparison with the conventional heat roller type heating device.

Also, the quick start is possible to thereby dispense with preheat upon the non-printing operation and it is possible to save electric power in a total sense.

FIG. 6 is a schematic structural model view (cross-sectional model view) of a typical example of a heat-fixing apparatus using a film heating system. This apparatus is composed of a ceramic heater 7 as a heating body, a stay 13 that is a support member for supporting and insulating the heater 7, a cylindrical film 12 made of heat resistant resin, which surrounds loosely the stay 13 for supporting the heater 7, a pressure roller 9 being in press-contact with the heater 7 with the film 12 interposed therebetween for defining a nip portion N, and the like.

The pressure roller 9 is rotated in a counterclockwise direction indicated by the arrow by means of drive means M.

With the rotation of the pressure roller 9, a rotary torque is applied to the film 12 by a frictional force between the pressure roller 9 and the film 12 in the nip portion N so that the film 12 is kept under the condition that it is accordingly caused to rotate in the clockwise direction indicated by the arrows about the stay 13 with its inner surface in sliding contact with the heater 7 surface. The stay 13 serves also as a guide member for the rotating film 12.

Under the condition that the pressure roller 9 is drivingly rotated, the film 12 is driven in accordance with this rotation and an electric power is fed to the heater 7 so that it is heated to a predetermined fixing temperature under the control, a recording material P to be fixed with an image as the heated member to be conveyed from a recording portion of an image forming apparatus (not shown) is introduced between the film 12 of the nip portion N and the pressure roller 9 to be conveyed while being clamped together with the film 12 through the nip portion N, whereby the heat of the heater 7 is given to the recording material P via the film 12 to soften an unfixed image (toner image) t to the surface of the recording material P to perform the heat fixing of it. The recording material P that has passed through the nip portion N is conveyed and separated in accordance with its curvature in order from the surface of the film 12. In order not to adhere the unfixed toner on the surface of the film 12, a heat resistant releasing layer made of fluorine resin or the like that is superior in releasing property is provided thereon.

FIGS. 7A to 7C are views showing a structural example of the ceramic heater 7 as a heating body. FIG. 7A is a schematic partially fragmental plan view of a front surface side of the heater. FIG. 7B is a schematic plan view of a rear surface side of the heater. FIG. 7C is an enlarged cross-sectional, schematic view of the heater.

The heater 7 is formed by laminating and baking in order by a screen printing technology a resistor pattern 2 heated by feeding electric power, a folded electrode 6, a power feeding electrode 5, a conductive pattern 5*a* that is an extended portion of the power feeding electrode 5 and a surface protective glass layer 3 on the front surface side of a ceramic substrate 1 such as alumina, aluminum nitride, silicon carbide or the like. A temperature detecting element (thermistor or the like) 4 is provided on the rear surface side of the ceramic substrate 1.

A power supply (AC input) is performed to the resistor pattern 2 through the power feeding electrode 5 and the conductive pattern 5*a* from a power feeding circuit (not shown) to thereby rapidly elevate a temperature of the heater 7 as a whole.

For the temperature control of the heater 7, the temperature detecting element 4 is brought into contact with a rear surface of the heater 7 so that the temperature is outputted as a voltage and furthermore, the output is calculated by a control circuit (not shown) such as a CPU to thereby adjust the AC input to the heater 7.

In this kind of conventional heating device, a ceramic heater using an alumina or tike as a heating body has been used. However, the device has suffered from problems in that the ceramic is fragile, a cost is high, the ceramic is not suitable for bending machining or the like.

Therefore, the present applicant proposes a heating device using a metal plate as substrate for heating body in Japanese Patent Application Laid-open Nos. 9-244442 and 10-275671 in advance. In this heating device, as a heating body, an insulating layer is formed on a metallic substrate to form the same substrate having the insulating property as the conventional ceramic substrate and a resistor pattern, a conductive pattern and an insulating sliding layer as an uppermost layer are formed thereon.

Thus, the substrate is made of metal to thereby enhance the mechanical strength of the heater.

On the other hand, in order to enhance the fixing property of the toner, it is proposed to provide an elastic layer on a film. In particular, in the case where the images of the overlapped toner layers as in the color image are to be fixed, it is possible to obtain the effect for surrounding the toner and the fixing property can be further enhanced by providing the elastic layer.

However, if the elastic layer is used in the film, the rigidity of the film is increased and the driving torque for the film is increased Also, in FIG. 5 of the above-described Japanese Patent Application Laid-open No. 9-244442, the structure in which a nip surface side of the metallic substrate is formed into an arcuate shape is described.

However, since the opposite surface to the nip surface is flat, the thickness of the substrate is increased so that the responsibility of the temperature detecting element provided in the opposite surface side to the nip is degraded. For this reason, although in this fixing apparatus, it is easy to perform the fine adjustment of the temperature of the heater and it is possible to suppress the temperature ripple inherently, since the responsibility of the temperature detecting element is degraded, the temperature ripple is remarkable.

SUMMARY OF THE INVENTION

The present invention has been made in view of the problems described above, and an object of the present invention is to provide a heater that has a mechanical strength and may suppress a driving torque of a film and an image heating apparatus using this heater.

Another object of the present invention is to provide a heater that may suppress a driving torque of a film without sacrificing a responsibility of a temperature detecting element and an image heating apparatus using this heater.

Still another object of the present invention is to provide a heater that has a mechanical strength in low cost and an image heating apparatus using this heater.

Still another object of the present invention is to provide an image heating apparatus for heating an image formed on a recording material, including: a heater, the heater including a metallic substrate; a film moving in contact with the heater; and a back-up roller for defining a nip with the heater via the film; in which the metallic substrate has a convex surface on the nip side and a concave surface on the opposite surface.

Still another object of the present invention is to provide a heater, including: a metallic substrate; and a heat generating resistor; in which the metallic substrate has a convex surface on one side and a concave surface on the opposite side.

Another object of the present invention will be more apparent from the following detailed description with reference to the accompanying drawings.

DESCRIPTION OF THE PREFERRED EMBODIMENTS

Embodiment 1

Figure 1:
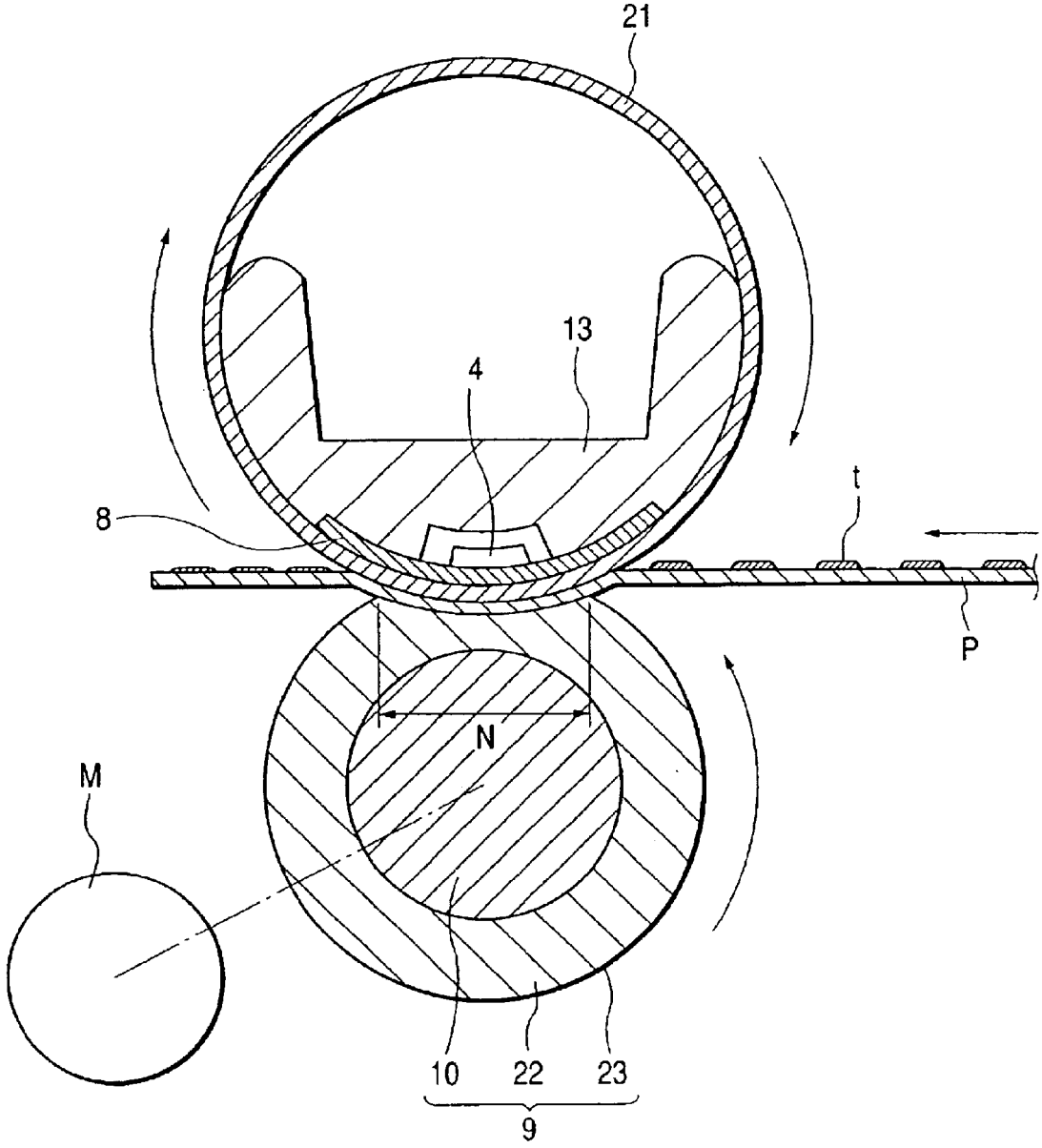
FIG. 1 is a cross-sectional view of an image heating apparatus in accordance with a first embodiment of the present invention.

FIG. 1 shows a schematic structural model view (cross-sectional model view) of a heating apparatus in accordance with an embodiment of the present invention.

Figure 6:
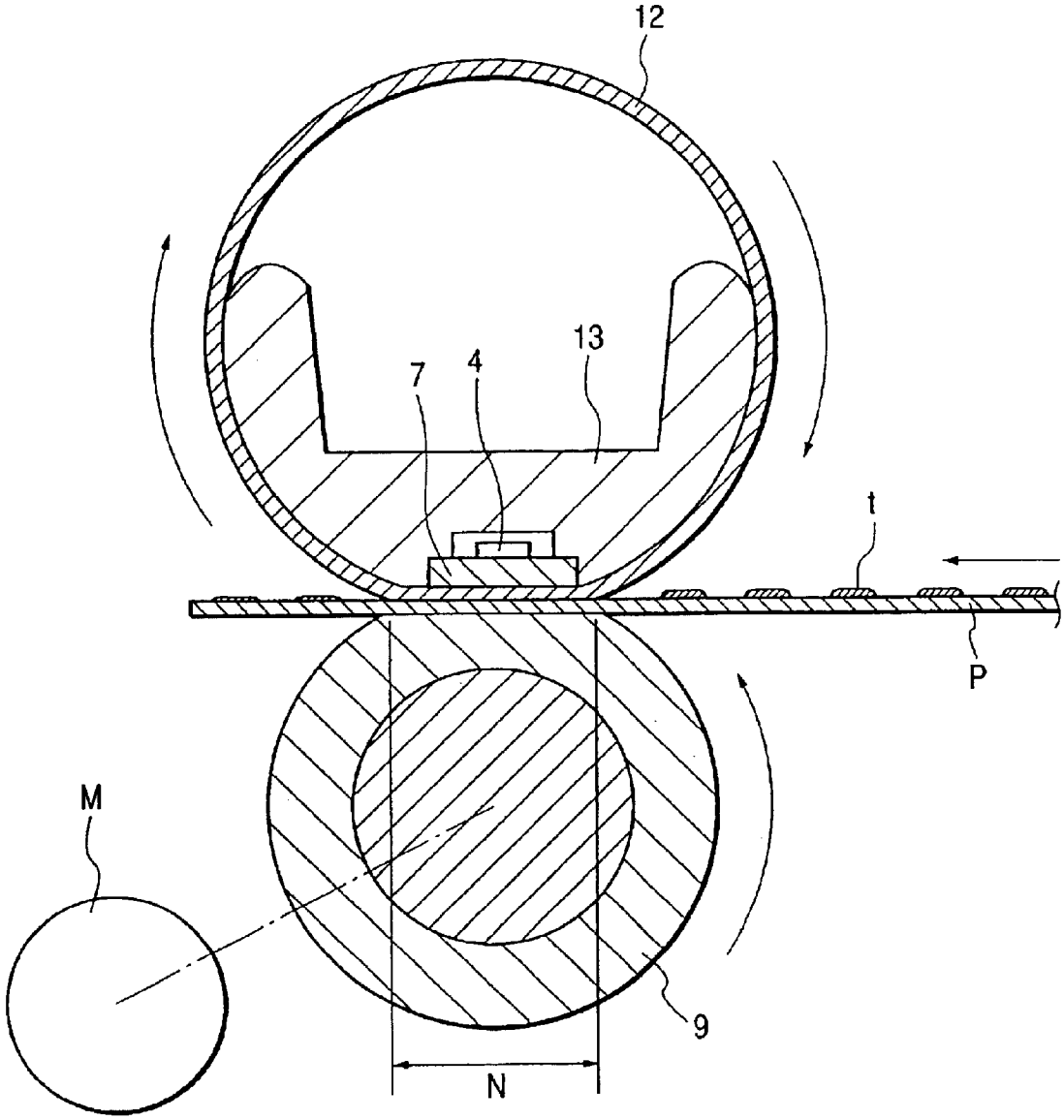
FIG. 6 PRIOR ART
FIG. 6 is a cross-sectional view of a conventional film type image heating apparatus.
Figure 7A:
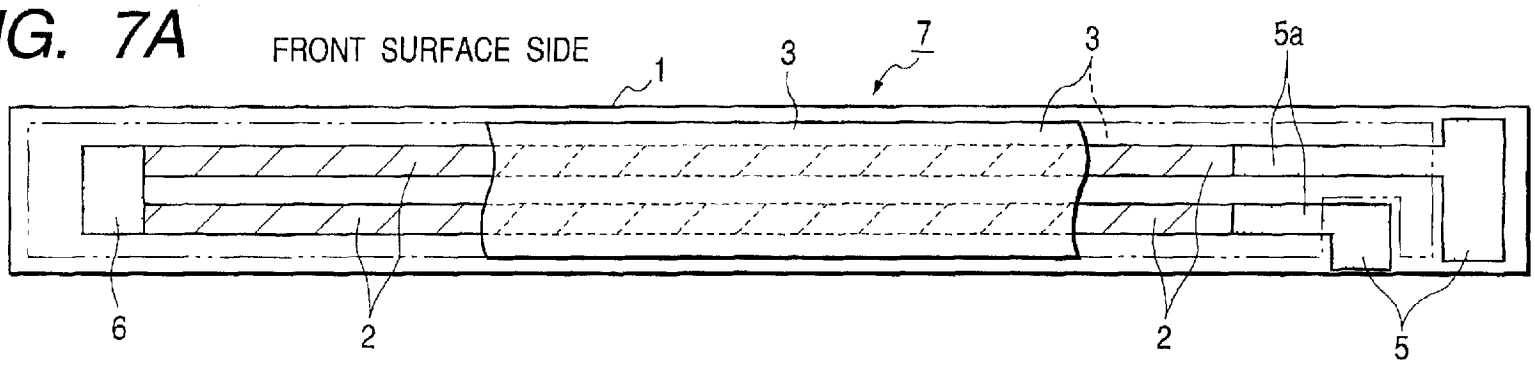
FIGS. 7A, 7B and 7C are structural illustrations of a heater having a ceramic substrate.
Figure 7B:
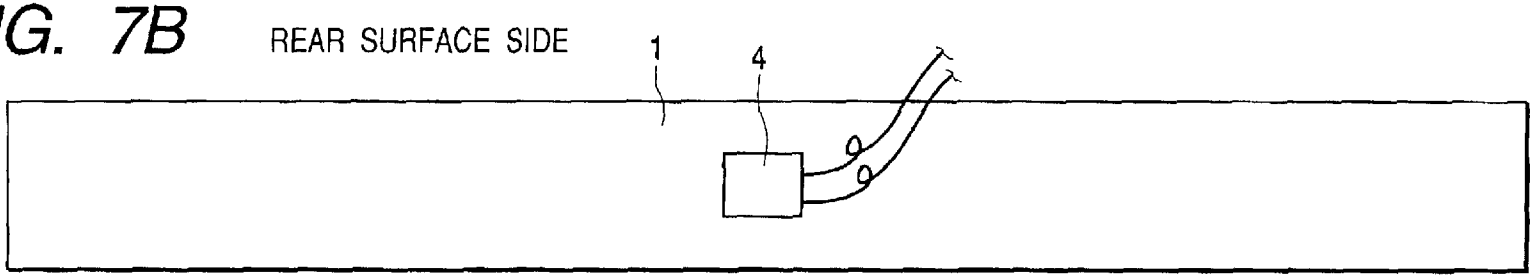
Figure 7C:
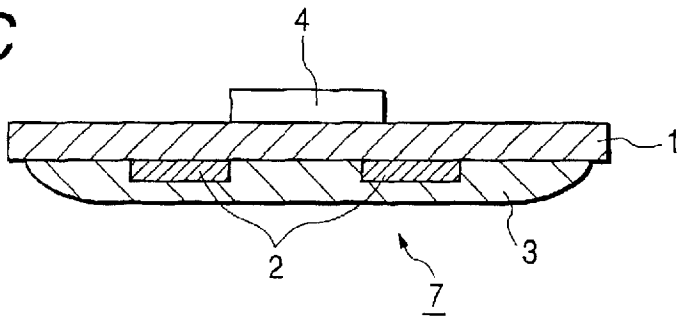

A heating apparatus according to this embodiment is a pressure roller drive type and film heating type heat-fixing apparatus using a cylindrical (endless type) film basically in the same manner as in the apparatus described in conjunction with FIG. 6. The same reference numerals are used to indicate the like components or members to thereby avoid the duplication of explanation.

The heating apparatus according to this embodiment is characterized in that a curved heater (arch-shaped heater) having a substrate made of metal is used as a heating body 8 and that a film provided with an elastic layer is used as a film 21.

(1) Curved Heater 8

Figure 2A:
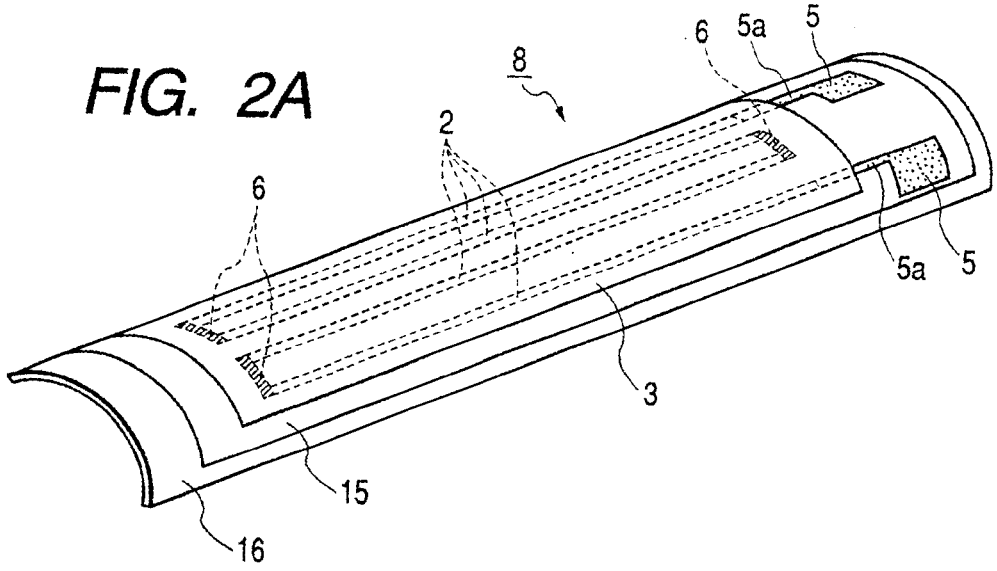
FIGS. 2A, 2B and 2C are structural views for illustrating an arch-shaped heater.
Figure 2B:
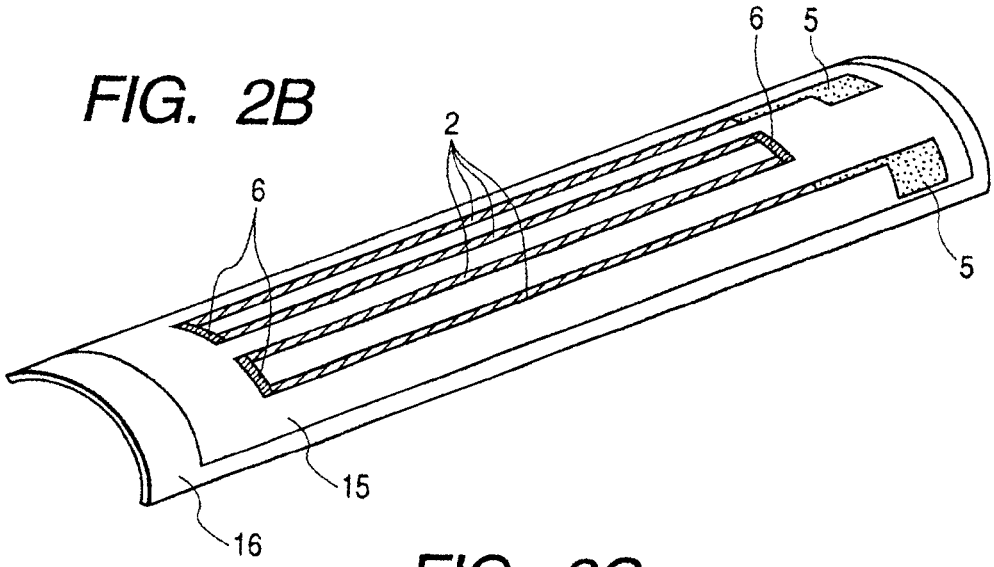
Figure 2C:
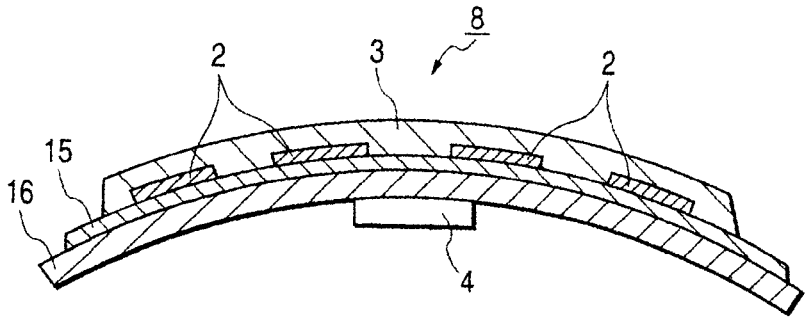

FIGS. 2A to 2C are structural views of the curved heater 8 according to this embodiment. FIG. 2A is a perspective view showing a front surface side of the curved heater 8, FIG. 2B is a perspective view showing the heater in such a state that a surface protective glass layer 3 has been removed, and FIG. 2C is an enlarged cross-sectional schematic view.

Reference numeral 16 denotes a curved metallic substrate (electric conductive substrate) of the heater 8, which is made of metal or the like such as SUS430 (stainless steel) that is likely to be identified with the glass in thermal expansion coefficient. A dimension of the metallic substrate 16 is, for example, a length of 270 mm, a radius of curvature of 12 mm, a circumferential length of 20 mm, and a thickness of 0.6 mm. A flat metal plate is bent and formed into an arch-shape. Accordingly, one side surface is convex and the opposite surface is concave.

An insulating glass layer 15 (first insulating layer) is formed over almost all the front surface of the metallic substrate with the convex surface side of the metallic substrate 16 used as a front surface side. Over its surface, a resistor pattern 2, a folded electrode 6, a power feeding electrode 5, a conductive pattern 5*a* that is an extended portion of the power feeding electrode 5 and a surface protective glass layer 3 (second insulating layer) are laminated and baked in order by screen printing. A temperature detecting element (thermistor or the like) 4 is provided on a rear surface side of the metallic substrate 16.

It is preferable that the thickness of the metallic substrate 16 be in the range of 0.5 mm to 2 mm. If it is too thin, a large warpage is generated due to the difference in thermal expansion coefficient after printing and it is difficult to perform the assembling work. Also, if it is too thick, the heat capacity of the heater 8 is increased and in the case where the temperature detecting element 4 such as a thermistor is brought into contact from the rear surface, the response is delayed so that the desired control becomes difficult to perform. This causes generation of image problems such as fixing fault, non-uniformity in gloss, offset or the like.

Figure 3:
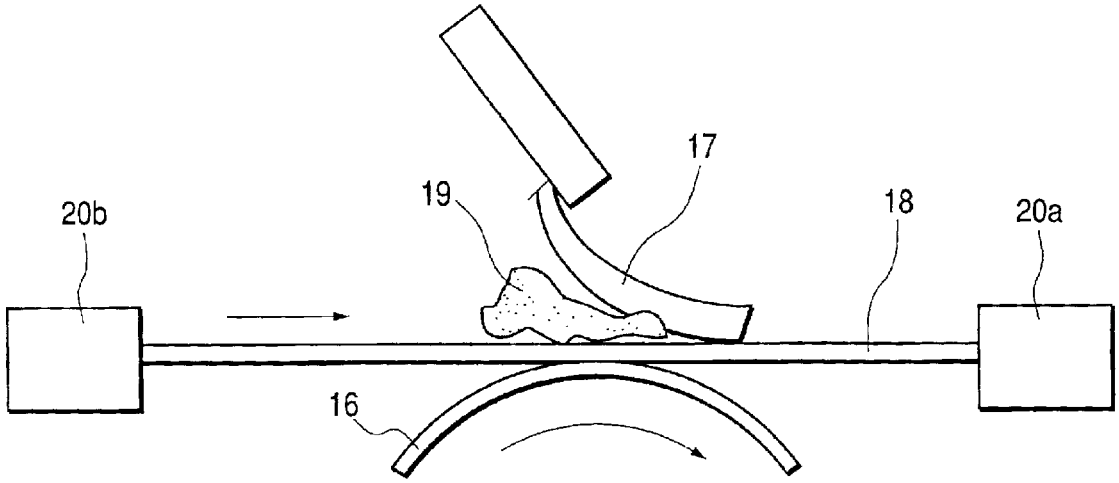
FIG. 3 is an explanatory view of a manufacturing process when a heat generating resistor layer or an electrode is to be printed onto a metallic substrate of the heater.

As shown in FIG. 3, a squeegee 17 is fixed and the metallic substrate 16 is rotated under a screen 18 mounted on stages 20*a* and 20*b* while moving the screen 18 so that paste 19 for forming each pattern layer is supplied in a method of printing the resistor pattern 2, the folded electrode 6, the power feeding electrode 5, the conductive pattern 5*a* that is the extended portion of the power feeding electrode 5 and the surface protective glass layer 3 on the substrate 16 having an arch-shape.

It is preferable that the thickness of the insulating glass layer 15 be in the range of 30 microns to 100 microns in order to have a resistance to voltage that is not smaller than 1.5 kV, and it is preferable to take a method of printing a plurality of times in order to avoid the pin holes. Also, in order to enhance the adhesion between this insulating glass layer 15 and the metallic substrate 16, it is preferable to roughen the metallic substrate 16 by sand blasting or etching and print the insulating glass layer 15 after degreasing. Since this insulating glass layer 15 has a function not only to provide the voltage resistance but also to prevent the heat generated in the resistor pattern 2 from escaping toward the substrate 16, it is preferable that the heat conductivity be not higher than 2W/(m·K).

The resistor pattern 2, the folded electrode 6, the power feeding electrode 5 and the conductive pattern 5*a* that is the extended portion of the power feeding electrode 5 are printed on this insulating glass layer 15.

The surface protective glass layer 3 is printed as the uppermost layer. The surface protective glass layer 3 requires the smoothness for the sliding property with the film 12, the insulating property and the high heat conductivity (preferably, 2W/(m·K).

These glass layers and resistor patterns are baked to be formed after printing by using screen printing in the same manner as in the conventional ceramic heater. The resistor pattern 2 requires such a length that it may contain paper having a maximum size to be passed therethrough.

(2) Film 21

Figure 4:
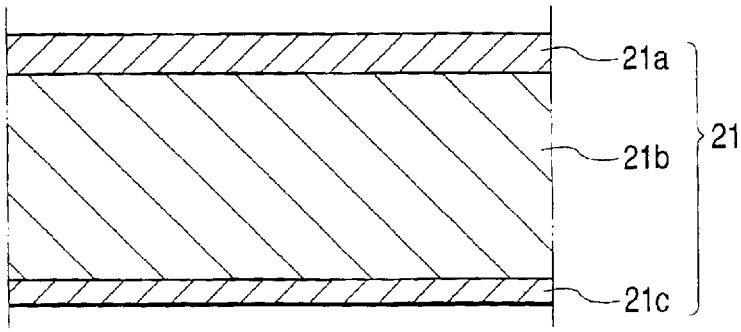
FIG. 4 is a partially cross-sectional view illustrative of a structure of a film.

As shown in the layer structural model view of FIG. 4, the film 21 is a three-layer film of a heat resistant resin substrate 21*a* made of polyimide, polyamide, polyamideimide or the like, an elastic layer 21*b* made of silicone rubber, fluororubber, or the like, and a releasing layer (surface layer) 21*c* made of fluororesin such as PFA, PTFE, FEP or the like.

More specifically, in this embodiment, the polyimide was formed into a cylinder having a thickness of 40 microns, a length of 230 mm and an inner diameter of 24 mm as the heat resistant resin substrate 21*a*. Thereafter, silicone rubber in a liquid form (having JIS-A hardness not less than 5 degrees) was coated so as to have a thickness of 100 $\mu$m on an outer surface of the cylindrical resin substrate 21*a* by a roll coater or the like without removing it away from molds. Thereafter, the substrate was thermally cured for 30 minutes at 130° C. Subsequently, the substrate was subjected to a secondary vulcanization for four hours in an oven set at 200° C. to form a silicone rubber layer as the elastic layer 21*b* having a thickness of 0.5 mm.

The surface of the silicone rubber layer was subjected to a predetermined primer process (GLP103SR: Daikin Industries, Ltd). Thereafter, fluorine rubber latex (GLS213: Daikin Industries, Ltd.) was sprayed and coated as the releasing layer 21*c* and dried at 70° C. Thereafter, it was baked for thirty minutes in an oven set at 310° C. to form a surface layer having a thickness of about 30 $\mu$m. As a result, it was possible to form a good releasing layer with the surface layer of fluorine resin in the fluorine rubber latex having about 1 to 3 $\mu$m.

It is possible to form the substrate layer 21*a* of metal in order to enhance the heat conductivity of the film.

The thus produced heater 8 and the film 21 were attached to the heating apparatus as shown in FIG. 1.

Note that, reference numeral 13 denotes a holder for insulating holding the heater 8. Its part serves as a guide member for the film 21.

Since the nip side of the metallic substrate is convex as described above, the sliding property with the film is superior and it is possible to reduce the driving torque of the film. In particular, since the surface on the nip side of the heater 8 and the surface on the nip side of the holder 13 (film guide surface) are connected smoothly with each other, the sliding property with the film is superior. Thus, it is sufficient to make the curvature of the surface on the nip side of the heater and the curvature of the surface (film guide surface) on the nip side of the holder substantially identified in order to smoothly connect each surface of the heater and holder (see FIG. 1).

Furthermore, since the nip side of the metallic substrate is convex and in addition, the surface on the opposite side to the nip is concave, the sliding property with the film is kept well and the heat capacity of the metallic substrate is not increased. It is possible to improve the responsibility of the thermistor.

Also, in the case where the substrate layer of the film is made of metal rather than the resin, the rigidity of the film is rather high, and thus the formation of the surface on the nip side of the heater into a curved surface contributes to the maintenance of the smooth movement of the film.

Silicone rubber (JIS-A hardness of 14 degrees) was formed with a thickness of 3 mm as the elastic layer 22 on a core metal 10 (having a diameter of 14 mm) for the pressure roller 9. Thereafter, the surface of the silicone rubber layer 22 was subjected to a predetermined primer process (GLP103SR: Daikin Industries, Ltd). Thereafter, fluorine rubber latex (GLS213: Daikin Industries, Ltd.) was sprayed and coated as the releasing layer 23 and dried at 70° C. Thereafter, it was baked for thirty minutes in an oven set at 310° C. to form a surface layer 23 having a thickness of about 30 $\mu$m. As a result, it was possible to form a good releasing layer with the surface layer of fluorine resin in the fluorine rubber latex having about 1 to 3 $\mu$m.

This pressure roller 9 was pressurized at 150 N in total and rotated to thereby drive the film 21. As a result, it was possible to obtain the heating apparatus that might mix colors even for an OHT sheet well up to the conveyance velocity of 100 mm/sec of the recording material P that was a member to be heated. Namely, it was possible to form the image that was superior in light transmission even if the color toner image was fixed on the OHT sheet.

The heating body 8 was formed into a curved heater to thereby enhance the sliding property with the film 21 and to thereby reduce the load or torque for driving the film 21. It was possible to heat the toner image so as to surround the toner image by laminating the elastic layer 21*b* on the heat resistant resin substrate 21*a* as the film 12. As a result, the mixture of color was improved. It was possible to project the color image even onto the overhead projector sheet. Also, it was possible to obtain the image having no non-uniformity in gloss regardless of the kind of sheet even for the monotone image. Also, since the surface on the nip side of the heater was convex and in addition the opposite surface was convex, even if the thermistor is provided on the opposite surface, the responsibility of the thermistor was excellent.

Embodiment 2

In the above-described Embodiment 1, the heating body (heater) 8 is formed into a plate-like curved surface.

Figure 5:
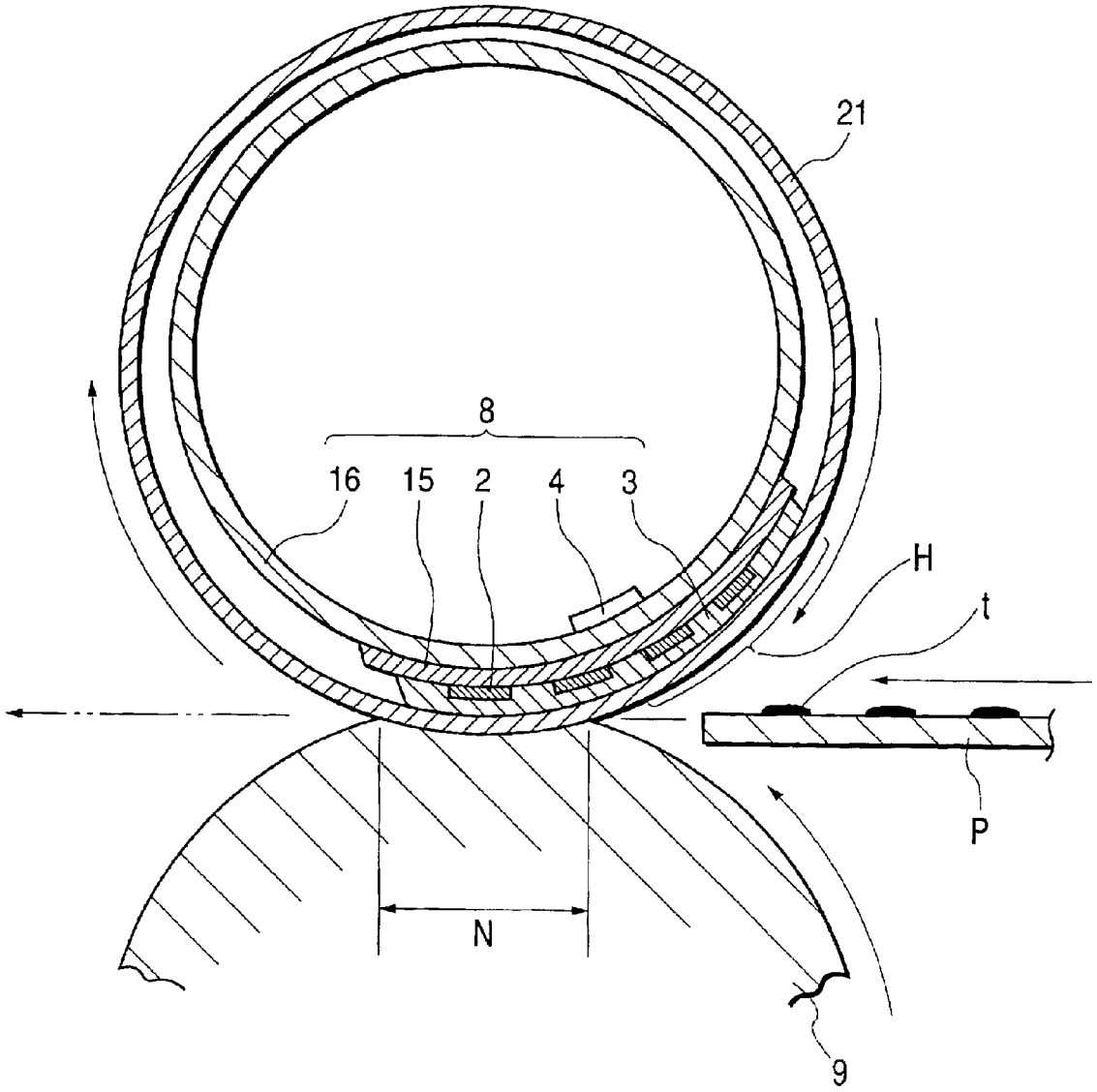
FIG. 5 is a cross-sectional view of an image heating apparatus in accordance with a second embodiment of the invention.

However, a heating body (heater) 8 according to this embodiment takes a cylindrical shape as shown in FIG. 5. Namely, the metallic substrate 16 is formed into a cylindrical shape. Then, the insulating glass layer 15, the resistor pattern 2, the folded electrode 6, the power feeding electrode 5, the conductive pattern 5*a* that is the extended portion of the power feeding electrode 5 and the surface protective glass layer 3 are printed and backed on the outer surface of this cylindrical metallic substrate 16 in the same manner as in Embodiment 1.

The heater is formed into a cylindrical shape so that the heater per se is used as a support member (stay) for pressurizing to thereby simplify the structure.

Also, since the region in which the area of the resistor pattern 2 may be adjusted as desired is increased, it is possible to cope with the high speed operation.

Conventionally, a surface heat generating type roller has been proposed, but it requires the uniform heating in any part of the circumferential direction. However, in accordance with this embodiment, as shown in FIG. 5, the heating region H is expanded toward the upstream side of the nip portion N as desired but is not intended to uniformly heat the circumferential direction of the cylindrical metallic substrate 16 as a whole. Also, the cylindrical heating body 8 per se is fixed but not rotated. There are a small number of appendixes such as a bearing or a gear and the heat capacity is small.

It is a matter of course that the heating apparatus according to the present invention is not limited to the heat-fixing apparatus according to the embodiments. Further, it is a matter of course that the present invention may be extensively applied to, for example, an image heating apparatus for improving the surface property such as gloss by heating the recording material bearing an image, an image heating apparatus for prefixing, a heating apparatus for performing the feeding, drying, laminating, and heat pressing for removing creases of the sheet-like member, a heating apparatus for drying used in an ink jet printer or the like.

Also, it is a matter of course that a structure of the heating apparatus per se to which the heating body according to the present invention is applied is not limited to those shown in the embodiments. It will be understood that the present invention is not limited to the specific embodiment but may be modified and changed within the scope of the technical spirit of the invention.

What is claimed is:

1. An image heating apparatus for heating an image formed on a recording material, comprising:

a heater, said heater including a metallic substrate, which is fixed so as not to rotate with respect to said apparatus;

a film moving in contact with said heater; and a back-up roller for defining a nip with said heater via said film, wherein said metallic substrate has a cylindrical shape, and wherein said heater has a first insulating layer on an outer peripheral surface of said metallic substrate, a heat generating resistor on said first insulating layer and a second insulating layer on said heat generating resistor.

2. An image heating apparatus according to claim 1, wherein said heat generating resistor is formed on a part of said metallic substrate in a circumferential direction.

3. An image heating apparatus according to claim 2, wherein a part of said heat generating resistor is opposite to the nip.

4. An image heating apparatus according to claim 1, wherein said second insulating layer of said heater is in contact with said film.

5. An image heating apparatus according to claim 1, wherein a thickness of said metallic substrate is in a range of 0.5 mm to 2 mm.

6. A heater for use in an image heating apparatus, said heater being adapted to be fixed so as not to rotate with respect to the image heating apparatus that has a film moving in contact with said heater, and a back-up roller for defining a nip with said heater via the film, said heater comprising:

a metallic substrate having a cylindrical shape;

a first insulating layer on said metallic substrate;

a heat generating resistor on an outer peripheral surface of said first insulating layer; and a second insulating layer on said heat generating resistor.

7. A heater according to claim 6, wherein said heat generating resistor is formed on a part of said metallic substrate in a circumferential direction.

* * * * *

UNITED STATES PATENT AND TRADEMARK OFFICE

CERTIFICATE OF CORRECTION

PATENT NO. : 6,865,362 B2
DATED : March 8, 2005
INVENTOR(S) : Yasumasa Otsuka et al.

It is certified that error appears in the above-identified patent and that said Letters Patent is hereby corrected as shown below:

Title page,
Item [56], References Cited, FOREIGN PATENT DOCUMENTS, "11016667 A" should read -- 11-016667 A --.

Column 2,
Line 61, "for" should read -- for a--.

Column 5,
Line 32, "2W/(m·K)." should read -- 2W/(m·K)). --.
Line 67, "having" should read -- having a thickness --.

Column 6,
Line 42, "having" should read -- having a thickness --.

Signed and Sealed this

Second Day of August, 2005

JON W. DUDAS
*Director of the United States Patent and Trademark Office*